US008989421B2

(12) United States Patent
Akino

(10) Patent No.: US 8,989,421 B2
(45) Date of Patent: Mar. 24, 2015

(54) NOISE PREVENTING GOOSENECK MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 89 days.

(21) Appl. No.: 13/137,364

(22) Filed: Aug. 9, 2011

(65) Prior Publication Data

US 2012/0063629 A1 Mar. 15, 2012

(30) Foreign Application Priority Data

Sep. 10, 2010 (JP) ..... 2010-202848

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 1/08*** | (2006.01) |

(52) U.S. Cl.

CPC ..... *H04R 1/086* (2013.01)
USPC ..... 381/355; 381/361

(58) Field of Classification Search

USPC ..... 381/355, 356, 361, 369
See application file for complete search history.

(56) References Cited

U.S. PATENT DOCUMENTS

| | | | | |
|---|---|---|---|---|
| 6,549,632 | B1 * | 4/2003 | Akino et al. | 381/174 |
| 6,560,345 | B1 * | 5/2003 | Hachisuka | 381/369 |
| 2005/0254679 | A1 * | 11/2005 | Akino | 381/390 |
| 2005/0276428 | A1 * | 12/2005 | Akino | 381/170 |
| 2006/0078149 | A1 * | 4/2006 | Akino et al. | 381/369 |
| 2008/0144875 | A1 * | 6/2008 | Akino | 381/361 |

* cited by examiner

*Primary Examiner* — Brian Ensey
*Assistant Examiner* — Katherine Faley
(74) *Attorney, Agent, or Firm* — Manabu Kanesaka

(57) ABSTRACT

A gooseneck microphone has a configuration capable of preventing both of the occurrence of noise caused by extraneous electromagnetic waves and the occurrence of noise caused by electric discharge when touched. The gooseneck microphone includes a microphone unit having an electrostatic acousto-electric converter and a metal unit casing; a unit holder having a circuit board mounted with an impedance converter electrically connected to an output side of the acousto-electric converter, a cylindrical outer cylinder body, a cylindrical inner cylinder body arranged in the outer cylinder body, and a synthetic resin cover member covering the outer cylinder body; a metal support pipe having flexibility, the unit holder being supported on one end side of the support pipe; and a microphone cable having a two-core shield covering cable and inserted through the support pipe, one end side of the microphone cable being brought into the unit holder.

13 Claims, 1 Drawing Sheet

NOISE PREVENTING GOOSENECK MICROPHONE

CROSS-REFERENCE TO RELATED APPLICATION

The present application is based on, and claims priority from, Japanese Application Serial Number JP2010-202848, filed Sep. 10, 2010, the disclosure of which is hereby incorporated by reference herein in its entirety.

TECHNICAL FIELD

The present invention relates to a microphone having a flexible pipe (hereinafter, referred to as a gooseneck microphone), in which a microphone unit is provided on a distal end side of a flexible support pipe including a flexible shaft. More particularly, it relates to a technique for preventing the occurrence of noise caused by extraneous electromagnetic waves and the occurrence of noise caused by electric discharge when touched.

BACKGROUND ART

In the gooseneck microphone, a microphone unit is provided on the distal end side of a flexible support pipe including a flexible shaft. The microphone of this type has been used favorably for conferences and the like because the microphone unit can easily be brought close to the mouth of a speaking person.

For the gooseneck microphone, usually, as the microphone unit, a condenser microphone unit has been used. The condenser microphone unit has an impedance converter consisting of a field effect transistor (FET) because the impedance of an electrostatic acousto-electric converter in which a diaphragm and a backplate are arranged opposedly is high.

In recent years, cellular phones have been used everywhere, and are sometimes used even in a conference room. Although not recognized too much, a cellular phone radiates considerably strong electromagnetic waves (producing, in the range of about several centimeters to several tens of centimeters, a field intensity equivalent to several tens of thousands of times the field intensity produced in a city by a commercial power source).

Therefore, if a cellular phone is used near a condenser microphone unit, a high-frequency current caused by the electromagnetic waves radiated from the cellular phone sometimes intrude into the unit. In this case, the high-frequency current is detected by the impedance converter in the unit, and a noise signal caused thereby is superposed on a sound signal, and is delivered from the microphone.

Accordingly, in the invention described in Japanese Patent Application Publication No. 2008-153815, a unit casing of the condenser microphone unit is electrically connected to a support pipe (both made of a metal) to provide grounding, and a shield cup is provided in the unit casing. The microphone unit of this invention is configured so that a microphone cable is brought into the shield cup, the shield cover of the microphone cable is electrically connected to the shield cup, and the impedance converter is housed in the shield cup.

According to this configuration, the unit casing is grounded via the support pipe, and the unit casing is electrically connected to the shield cover of the microphone cable, so that the occurrence of noise caused by the extraneous electromagnetic waves radiated from the cellular phone or the like can be prevented.

However, as the noise generated from the microphone, besides the noise caused by extraneous electromagnetic waves, the noise caused by electric discharge when touched is generated.

That is, when the speaking person touches the microphone unit to bring the microphone unit close to his/her mouth, a spark discharge occurs if the potential difference existing between the speaking person and the microphone unit exceeds the electric breakdown field of air. Thereby, noise is generated from the microphone. Also, even if the spark discharge does not occur, noise is sometimes generated from the microphone in the same manner if a sudden movement of electric charges occurs between the speaking person and the microphone unit.

To prevent the occurrence of noise caused by electric discharge when touched, the unit casing has only to be constructed of a material in which electric charges do not move suddenly, for example, a polymer material (plastic material) having high volume resistivity. In this case, however, the continuity of electrostatic shield is broken in a portion of the polymer material, and the high-frequency current caused by the extraneous electromagnetic waves may intrude into the unit casing from this portion.

Accordingly, an object of the present invention is to provide a gooseneck microphone having a configuration capable of preventing both of the occurrence of noise caused by extraneous electromagnetic waves and the occurrence of noise caused by electric discharge when touched.

SUMMARY OF THE INVENTION

To achieve the above object, the present invention provides a microphone having a flexible pipe, including a microphone unit in which an electrostatic acousto-electric converter is housed in a metal-made unit casing; a unit holder having a circuit board mounted with an impedance converter electrically connected to the output side of the acousto-electric converter; and a metal-made support pipe having flexibility, in which the unit holder is supported on one end side of the support pipe; the microphone unit is connected to the unit holder; and a microphone cable consisting of a two-core shield covering cable is inserted through the support pipe, and one end side thereof is brought into the unit holder, wherein the unit holder includes a cylindrical outer cylinder body formed of a metallic material, one end side of which is fixed to the support pipe with electrical connection and the other end side of which is connected to a unit casing of the microphone unit with electrical connection; a cylindrical inner cylinder body formed of a metallic material, which is arranged in the outer cylinder body, one end side of which is fixed to a shield cover conductor of the microphone cable with electrical connection, the other end side of which is mounted with the circuit board, and which is electrically connected to a ground pattern of the circuit board; and a synthetic resin-made cover member formed into a cylindrical shape covering the outer cylinder body, and is provided with a first electrostatic shield system leading from the unit casing to the support pipe through the outer cylinder body and a second electrostatic shield system leading from the ground pattern of the circuit board to the shield cover conductor through the inner cylinder body.

According to the present invention, the inflow of a high-frequency current caused by extraneous electromagnetic waves into the microphone is hindered reliably. Also, since the unit holder touched by the speaking person is covered with the synthetic resin-made cover member, which is a member having high volume resistivity, the movement of electric charges is slow, and the occurrence of noise caused by electric discharge when touched can be prevented.

In the present invention, it is preferable that the outer cylinder body integrally include a large-diameter cylinder part connected to the unit casing and a small-diameter cylinder part fixed to the support pipe; the inner cylinder body integrally include a large-diameter cylinder part mounted with the circuit board and a small-diameter cylinder part fixed to the shield cover conductor; and the outside diameter of the large-diameter cylinder part of the inner cylinder body be approximately equal to the inside diameter of the large-diameter cylinder part of the outer cylinder body, whereby the inner cylinder body be supported coaxially in the outer cylinder body.

According to this configuration, the inner cylinder body can be assembled easily in the outer cylinder body without looseness.

DETAILED DESCRIPTION

An embodiment of the present invention will now be described with reference to FIGS. 1 and 2. The present invention is not limited to this embodiment.

Figure 1:
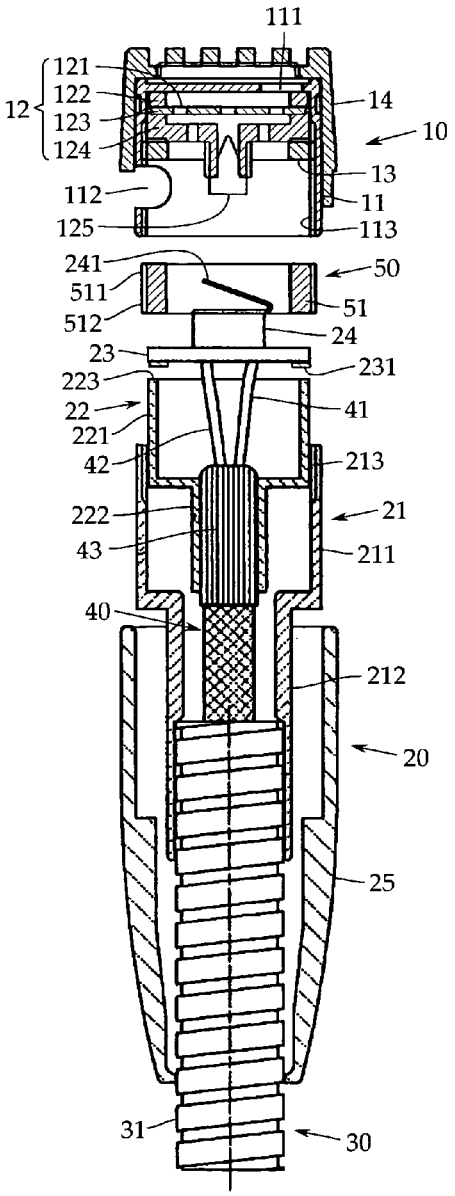
FIG. 1 is an exploded sectional view showing an essential portion of a gooseneck microphone in accordance with the present invention.
Figure 2:
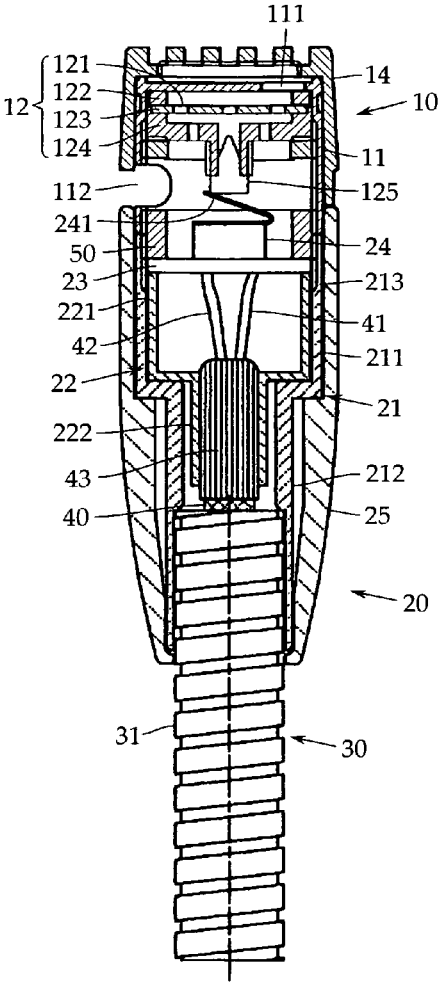
FIG. 2 is a sectional view showing an assembled state of the essential portion shown in FIG. 1.

Referring to FIGS. 1 and 2, a gooseneck microphone in accordance with this embodiment includes, as a basic configuration, a microphone unit 10, a unit holder (microphone body) 20, a support pipe 30 having flexibility, a microphone cable 40 inserted through the support pipe 30, and a connecting ring 50 for detachably connecting the microphone unit 10 and the unit holder 20 to each other.

The microphone unit 10 is a condenser microphone unit configured so that an electrostatic acousto-electric converter 12 is housed in a unit casing 11. The unit casing 11 is of a cylindrical shape and is formed of a metallic material such as aluminum or a brass alloy.

In this embodiment, since the microphone unit 10 is unidirectional, a front acoustic terminal 111 is provided on the front end wall of the unit casing 11, and a rear acoustic terminal 112 is provided on the rear end side of the peripheral surface of the unit casing 11. Also, internal threads 113 for connection is formed on the inner peripheral surface of the unit casing 11.

The electrostatic acousto-electric converter 12 includes a diaphragm 121 and a backplate 123, which are arranged opposedly via a small void with an electrical insulating spacer ring, not shown, being held therebetween.

The diaphragm 121 is formed of a synthetic resin-made thin film having a metalized film on one surface on the counter backplate side, and is stretchedly provided on a metal-made diaphragm ring 122 with a predetermined tension. The metalized film is in contact with the diaphragm ring 122.

The backplate 123 is formed of a metal plate such as an aluminum plate. The backplate 123 is supported on an insulating seat 124 formed of, for example, a synthetic resin material. The backplate 123 and the insulating seat 124 each are formed with a large number of sound holes for causing the sound waves sent from the rear acoustic terminal 112 to act on the back surface side of the diaphragm 121.

On the back surface side of the insulating seat 124, an output terminal pin 125 of the microphone unit 10 is provided. The output terminal pin 125 is connected to the backplate 123 via a wiring member, not shown.

In the unit casing 11, a lock ring 13 is threadedly engaged with the internal threads 113 for connection, and the acousto-electric converter 12 is firmly fixed into the unit casing 11 by the lock ring 13.

Thereby, the diaphragm ring 122 adheres closely to the front end wall of the unit casing 11, and the metalized film of the diaphragm 121 is electrically connected to the unit casing 11 via the diaphragm ring 122. In this embodiment, the unit casing 11 is covered with a resonator 14.

The unit holder 20 serving as a microphone body includes an outer cylinder body 21 formed of a metallic material, an inner cylinder body 22 similarly formed of a metallic material, a circuit board 23 mounted with a field effect transistor (FET) 24 serving as an impedance converter, and a synthetic resin-made cover member 25 that is a member having high volume resistivity.

The support pipe 30 includes a flexible shaft 31 formed of a steel wire material, and the microphone cable 40 is inserted through the support pipe 30. The support pipe 30 may be configured by the flexible shaft 31 as a whole.

FIGS. 1 and 2 show only the distal end side of the support pipe 30 (the flexible shaft 31). On the rear end side (the proximal end side), not shown, of the support pipe 30, a power module section including an output circuit, an output transformer, and the like for the sound signals is provided.

As the microphone cable 40, a two-core shield covering cable having a feeder line 41, a signal line 42, and a shield cover conductor 43 is used, and one end side of the microphone cable 40 is brought into the unit holder 20, and the other end side thereof is connected to the power module section.

The outer cylinder body 21 includes a large-diameter cylinder part 211 and a small-diameter cylinder part 212 as a unit. The large-diameter cylinder part 211 has a diameter that is the same as the diameter of the unit casing 11, and is formed with internal threads 213 for connection on the inner peripheral surface on the opening side, so that the outer cylinder body 21 is detachably connected to the unit casing 11 via the connecting ring 50.

The connecting ring 50 is made of a metal, and has external threads 51 engaging with the internal threads 113 of the unit casing 11 and the internal threads 213 of the large-diameter cylinder part 211. In FIG. 1, an upper-side external thread part 511 engages with the internal threads 113 of the unit casing 11, and a lower-side external thread part 512 engages with the internal threads 213 of the large-diameter cylinder part 211, whereby the unit casing 11 and the large-diameter cylinder part 211 are connected to each other.

The small-diameter cylinder part 212 of the outer cylinder body 21 is fixed to one end side of the flexible shaft 31 with electrical connection. As the fixing method, press fit, staking, and the like are preferable, and a conductive adhesive may be used additionally. Aside from this, the small-diameter cylinder part 212 may be connected to one end side of the flexible shaft 31 via a connector, not shown.

Like the outer cylinder body 21, the inner cylinder body 22 also includes a large-diameter cylinder part 221 and a small-diameter cylinder part 222 as a unit. Both of the outer cylinder body 21 and the inner cylinder body 22 are preferably made of a copper alloy, such as a brass, having high conductivity.

The outside diameter of the large-diameter cylinder part 221 of the inner cylinder body 22 may be smaller than the inside diameter of the large-diameter cylinder part 211 of the outer cylinder body 21. In this embodiment, as a preferred mode, the outside diameter of the large-diameter cylinder part 221 of the inner cylinder body 22 is made approximately equal to the inside diameter of the large-diameter cylinder part 211 of the outer cylinder body 21, so that in the state in which the large-diameter cylinder parts 211 and 221 are in contact with each other, the inner cylinder body 22 is supported coaxially in the outer cylinder body 21. According to this configuration, the inner cylinder body 22 can be assembled easily in the outer cylinder body 21 without looseness.

The small-diameter cylinder part 222 of the inner cylinder body 22 is fixed to the shield cover conductor 43 of the microphone cable 40 with electrical connection. As one example thereof, in this embodiment, the configuration is made such that, on one end side of the microphone cable 40, the shield cover conductor 43 is stripped and folded, the small-diameter cylinder part 222 of the inner cylinder body 22 is put on the folded portion of the shield cover conductor 43, and the small-diameter cylinder part 222 is staked.

At an opening end 223 of the large-diameter cylinder part 221 of the inner cylinder body 22, the circuit board 23 is arranged. In this embodiment, the circuit board 23 is mounted with the FET 24 serving as the impedance converter on one surface facing to the microphone unit 10, and on the gate electrode terminal of the FET 24, there is provided a contactor 241 consisting of a plate spring that is in elastic contact with the output terminal pin 125 of the microphone unit 10.

On the other surface (back surface) of the circuit board 23, the drain electrode terminal and the source electrode terminal (both not shown) of the FET 24 are provided. For example, the feeder line 41 is connected to the drain electrode terminal, and the signal line 42 is connected to the source electrode terminal.

At the peripheral edge of the other surface (back surface) of the circuit board 23, a ground pattern 231 of the circuit board 23 is formed throughout the entire periphery of the circuit board 23 so that, at the assembly time, the ground pattern 231 comes into contact with the opening end 223 of the large-diameter cylinder part 221 of the inner cylinder body 22.

The synthetic resin-made cover member 25 is formed into a cylindrical shape capable of covering the whole of the outer cylinder body 21 including a connecting portion between the outer cylinder body 21 and the unit casing 11, and is slidably attached to the flexible shaft 31.

One example of the assembling procedure is explained. First, the small-diameter cylinder part 212 of the outer cylinder body 21 is fixed to one end of the flexible shaft 31, and then the small-diameter cylinder part 222 of the inner cylinder body 22 is fixed to the shield cover conductor 43 of the microphone cable 40.

Next, the feeder line 41 and the signal line 42 of the microphone cable 40 are soldered to the circuit board 23, the circuit board 23 is placed at the opening end 223 of the large-diameter cylinder part 221 of the inner cylinder body 22, and the inner cylinder body 22 is fitted into the outer cylinder body 21.

The lower half of the external threads 51 (a lower-side external thread part 512) of the connecting ring 50 is threadedly engaged with the internal threads 213 of the large-diameter cylinder part 211 of the outer cylinder body 21. By this threaded engagement, the circuit board 23 is pushed against the opening end 223 of the large-diameter cylinder part 221 of the inner cylinder body 22.

Thereby, the unit holder 20 is assembled. The upper half of the external threads 51 (an upper-side external thread part 511) of the connecting ring 50 is threadedly engaged with the internal threads 113 of the unit casing 11 to connect the microphone unit 10 to the unit holder 20, and then the whole of the outer cylinder body 21 including the connecting portion between the outer cylinder body 21 and the unit casing 11 is covered with the cover member 25. Thus, the microphone is assembled as shown in FIG. 2.

In this assembled state, a double shield is formed by a first electrostatic shield system (a high-frequency system) leading from the unit casing 11 to the support pipe 30 through the outer cylinder body 21 and a second electrostatic shield system (a low-frequency system) leading from the ground pattern 231 of the circuit board 23 to the shield cover conductor 43 of the microphone cable 40 through the inner cylinder body 22. Therefore, for example, even if a cellular phone is used near the microphone, the inflow of the high-frequency current caused by extraneous electromagnetic waves into the unit holder 20 is hindered reliably.

Also, since the unit holder 20 serving as the microphone body is covered with the synthetic resin-made cover member 25, which is a member having high volume resistivity, even if the speaking person touches the unit holder 20, the movement of electric charges is slow, and the occurrence of noise caused by electric discharge when touched can be prevented.

The microphone unit 10 is usually covered with a wind screen formed of a sponge material to prevent wind noise caused by an air flow of an air conditioner and the like. Therefore, even if the speaking person touches the wind screen, the movement of electric charges scarcely occurs. However, considering the case where the wind screen is not put, it is preferable that the resonator 14 be made of a synthetic resin.

In the above-described embodiment, the configuration is made such that the microphone unit 10 is attachable to and detachable from the unit holder 20 via the connecting ring 50. However, an integral type in which the microphone unit 10 is integrated with the unit holder 20 is also embraced in the present invention.

The invention claimed is:

1. A gooseneck microphone, comprising:

a microphone unit having an electrostatic acousto-electric converter and a metal unit casing housing the electrostatic acousto-electric converter;

a unit holder having a circuit board mounted with an impedance converter electrically connected to an output side of the acousto-electric converter, a cylindrical outer cylinder body formed of a metallic material, a cylindrical inner cylinder body formed of a metallic material and arranged in the outer cylinder body, and a synthetic resin cover member having a cylindrical shape and covering the outer cylinder body;

a metal support pipe having flexibility, the unit holder being supported on one end side of the support pipe;

a resonator covering the unit casing so that an end of the unit casing protrudes downwards from an end of the resonator, the end of the resonator abutting against an upper end of the synthetic resin cover member outside the unit casing;

a connecting ring disposed on the circuit board, and connecting the unit casing of the microphone unit and the outer cylinder body of the unit holder to each other; and a microphone cable having a two-core shield covering cable with a shield cover conductor, the microphone cable being inserted through the support pipe and one end side of the microphone cable being brought into the unit holder, wherein one end side of the outer cylinder body is fixed to the support pipe with electrical connection and the other end side thereof is connected to the unit casing of the microphone unit with electrical connection; one end side of the inner cylinder body is fixed to the shield cover conductor of the microphone cable with electrical connection, and the other end side thereof is mounted with the circuit board and is electrically connected to a ground pattern of the circuit board; and the synthetic resin cover member extends from a lower portion of the microphone unit, entirely covers the outer cylinder body and continues to the metal support pipe, and the microphone includes a first electrostatic shield system formed of the unit casing, the outer cylinder body and the support pipe, and a second electrostatic shield system formed of the ground pattern of the circuit board, the inner cylinder body and the shield cover conductor.

2. The gooseneck microphone according to claim 1, wherein the cylindrical outer cylinder body, the cylindrical inner cylinder body, and the synthetic resin cover member are separately formed from each other.

3. The gooseneck microphone according to claim 2, wherein the outer cylinder body integrally comprises a large-diameter cylinder part connected to the unit casing, and a small-diameter cylinder part having a diameter smaller than that of the large-diameter cylinder part and fixed to the support pipe; the inner cylinder body integrally comprises a large-diameter cylinder part mounted with the circuit board, and a small-diameter cylinder part having a smaller diameter than that of the large-diameter cylinder part and fixed to the shield cover conductor; and an outside diameter of the large-diameter cylinder part of the inner cylinder body is substantially equal to an inside diameter of the large-diameter cylinder part of the outer cylinder body, so that the inner cylinder body is supported coaxially in the outer cylinder body.

4. The gooseneck microphone according to claim 3, wherein the inner cylinder body is completely housed in the outer cylinder body; and the large-diameter cylinder part of the inner cylinder body is surrounded by the large-diameter cylinder part of the outer cylinder body, and the small-diameter cylinder part of the inner cylinder body is surrounded by the small-diameter cylinder part of the outer cylinder body.

5. The gooseneck microphone according to claim 3, wherein the unit casing has first internal threads, the large-diameter cylinder part of the outer cylinder body has second internal threads, the connecting ring has external threads, and the external threads of the connecting ring engage with the first internal threads and the second internal threads.

6. The gooseneck microphone according to claim 4, wherein an upper side of the connecting ring engages the unit casing and a lower side of the connecting ring engages the outer cylinder body.

7. The gooseneck microphone according to claim 6, wherein the synthetic resin cover member covers the outer cylinder body and the connecting ring.

8. The gooseneck microphone according to claim 1, wherein the first electrostatic shield system has a high-frequency system, and the second electrostatic shield system has a low-frequency system.

9. The gooseneck microphone according to claim 1, wherein the circuit board is mounted on the cylindrical inner cylinder body, and the cylindrical outer cylinder body covers outside the circuit board and the cylindrical inner cylinder body.

10. The gooseneck microphone according to claim 9, wherein the cylindrical inner cylinder body and the cylindrical outer cylinder body are partly overlapped, and are disposed inside the synthetic resin cover member.

11. The gooseneck microphone according to claim 1, wherein the connecting ring has an upper side engaging the metal unit casing, and a lower side engaging the outer cylinder body to thereby connect the microphone unit and the outer cylinder body, the connecting ring holding the circuit board on the inner cylinder body inside the outer cylinder body.

12. The gooseneck microphone according to claim 11, wherein the resonator continues to the synthetic resin cover member outside the outer cylinder body.

13. The gooseneck microphone according to claim 12, wherein the ground pattern and the inner cylinder body are entirely located inside the outer cylinder body, and a part of the shield cover conductor is located inside the outer cylinder body.

* * * * *